United States Patent [19]

Iida

[11] Patent Number: 4,571,466

[45] Date of Patent: Feb. 18, 1986

[54] SPRING UNIT FOR A KEYBOARD

[75] Inventor: Hideo Iida, Tokyo, Japan

[73] Assignee: Kokoku Rubber Industrial Company Limited, Tokyo, Japan

[21] Appl. No.: 638,212

[22] Filed: Aug. 6, 1984

[30] Foreign Application Priority Data

Dec. 12, 1983 [JP] Japan ..... 58-232879

[51] Int. Cl.[4] ..... H01H 13/76

[52] U.S. Cl. ..... 200/5 A; 200/159 B

[58] Field of Search ..... 200/5 A, 159 B, 329, 200/340; 235/145 R

[56] References Cited

U.S. PATENT DOCUMENTS

| | | | |
|---|---|---|---|
| 3,489,342 | 1/1970 | Anderson | 235/145 R |
| 3,879,586 | 4/1975 | DuRocher et al. | 200/5 A |
| 3,930,083 | 12/1975 | Pinkham | 200/5 A X |
| 4,032,729 | 6/1977 | Koistinen | 200/340 X |
| 4,366,355 | 12/1982 | Oelsch | 200/5 A X |
| 4,408,103 | 10/1983 | Smith, III | 200/5 A X |
| 4,441,001 | 4/1984 | Miyano et al. | 200/5 A X |

FOREIGN PATENT DOCUMENTS

| | | | |
|---|---|---|---|
| 2054268A | 2/1981 | United Kingdom | 200/159 B |
| 2100517A | 12/1982 | United Kingdom | 200/159 B |
| 2113920A | 8/1983 | United Kingdom | 200/159 B |

OTHER PUBLICATIONS

Johnson, D. O. Jr.; IBM Technical Disclosure Bulletin; "Keyboard with Changeable Encoding and Key Designation"; vol. 13, No. 7, Dec. 1970, pp. 2041, 2042.

*Primary Examiner*—J. R. Scott

*Attorney, Agent, or Firm*—Kramer and Brufsky

[57] ABSTRACT

A spring unit for a keyboard comprises a base sheet having a specified number of openings perforated thereupon in accordance with a key layout and a number of dome-shaped spring members separated individually from each other, and each bearing a movable contact point for completing a circuit between fixed contact points. Each of the spring members is removably engaged with an opening in the base sheet. The spring members are molded from a high polymer resilient material and are easily replaceable.

8 Claims, 7 Drawing Figures

SPRING UNIT FOR A KEYBOARD

BACKGROUND OF THE INVENTION

This invention relates to a spring unit for a keyboard. Electronic calculators, office computers, word processors and other computer devices which are in widespread use, are provided with input operating boards or keyboards having a plurality of keys actuated by finger pressure. The keyboard comprises a plurality of key members, a plurality of controlling spring members and contact point means. So that smooth key touch can be obtained, there is a considerable amount of research and development being conducted on key members, springs, etc. Particularly, since the spring members are operated by finger pressure, they must have suitable resilience and stability so that a smooth and fatigueless key touch is obtained.

Originally controlling spring members were made of a metallic material, but recently they are being made of a high polymer resilient material.

A controlling spring member itself is a single unit. In accordance with recent developments, an array of controlling spring members is integrally formed on a keyboard, an arrangement which provides for good operability. This was made possible because of good workability of the high polymer resilient material.

FIGS. 1 and 2 in the drawings show the conventional art, in which the former is a plan view of a spring unit a for a conventional keyboard and the latter is an expanded partially cutaway section view in which the spring unit a is incorporated in the keyboard.

Referring first to FIG. 1, numeral 1 is a base sheet and numeral 2 is a spring integrally connected with the base sheet 1. Both the base sheet 1 and the spring 2 are made of a high polymer resilient material and are molded integrally as a spring unit a for the keyboard. The spring 2 which is roughly dome shaped has a head 3, on which a key top 4 is mounted. Numeral 5 is a movable contact point which is connected to the lowest part of the head 3.

Accordingly, when the key top 4 is pushed by a finger, the spring 2 is deformed. As the key top 4 is lowered further, the movable contact point 5 of the head 3 completes a circuit of two fixed contact points 8 and 9 of a lower printed circuit substrate 7, thereby transmitting an input signal.

Since the base sheet 1 and a plurality of springs 2 in the spring unit a form an integral structure, it is easy to incorporate the spring unit a in the keyboard 6. A disadvantage is that in the event a particular spring, such as for example 2*x*, corresponding to a specified key is deformed or inoperative, the entire base sheet 1 itself, being a single unit with its springs, becomes inoperative. Accordingly, the number of base sheets which must be rejected on manufacture increases and the yield rate of satisfactory products is lower, thereby increasing the cost of manufacture.

Further, if the key layout on the keyboard is modified to even a small extent, production of a new mold for the base sheet 1 is required. Additionally, when one wishes to have a specific key having an action property different from that of other keys, one is required either to provide a metal spring separately or to mold an entirely new spring unit a, in which a special key having a different action property is incorporated integrally. In particular, when one wishes to use a special spring 2 having a different action property on the base sheet 1, individual property adjustment for one key is cumbersome and the cost for producing a mold for such a special spring unit becomes very expensive.

Further, if one spring 2 should be inoperative due to abrasion, it would be useless to attempt repair of the spring 2; thus it is required to replace the entire spring unit a with a new one. Under such circumstances, all the springs 2 must be carefully manufactured to have a long life, thus increasing the cost of the keyboard.

As described above, according to the conventional spring unit for a keyboard, a large number of springs are formed integrally on the base sheet. Under these circumstances it is difficult to prescribe a desirable mold manufacturing condition and molding condition for obtaining suitable and uniform resilience of the springs or a desirable vulcanizing condition for the rubber which is used as the material of the spring unit. In addition, the heat shrinkage in such integral spring units is not constant in each condition; quality control of the spring unit, necessary to obtain a uniform distance between adjacent springs, becomes cumbersome. That is to say, in such integral spring units, it is difficult to maintain a uniform distance between adjacent springs. Accordingly, the conventional spring unit is very disadvantageous in view of production and cost.

BRIEF SUMMARY OF THE INVENTION

It is therefore an object of this invention to provide a spring unit for a keyboard in which a base sheet is separate from the spring members and each spring member is an individual unit removably engaged with a respective opening perforated in the base sheet. Thus, each spring member is easily replaceable, can be manufactured with a high degree of productivity, and the spring unit for a keyboard can provide excellent performance.

It is another object of this invention to provide a spring unit for a keyboard, which can be operated with some variations, e.g. by furnishing a spring member having a different action property, replacing individually an unsuitable spring member with a new one, or applying the spring unit to a larger keyboard.

It is another object of this invention to provide a spring unit for a keyboard in which, since the base sheet is separate from the spring members and each spring member is an individual unit, it is unnecessary to produce a special mold for molding a special spring unit for a keyboard and it becomes possible to eliminate the inconvenience of frequent mold exchange; thus each spring member is easily replaceable and any preferred spring member can be disposed on the base sheet. As a result, the spring unit for a keyboard can be manufactured at inexpensive cost.

It is another object of this invention to provide a spring unit for a keyboard, in which each spring member and the base sheet are engaged with each other by fitting the former into an opening of the latter, thereby providing for speedy and efficient engagement. Thus, while modifying the diameter of the openings in the base sheet and the tightness of the spring members' engagement, the resilience properties of the spring member may be modified at one's option.

It is another object of this invention to provide a spring unit for a keyboard, in which, since the material of the spring members can differ from that of the base sheet, each component can be separately produced so as to obtain the optimum properties.

It is a further object of this invention to provide a spring unit for a keyboard, in which the base sheet can be combined with a print substrate wired with an electric circuit, thereby enabling the production of a compact spring unit.

The foregoing and other objects and features of the invention will be apparent from a reading of the following description of the disclosure and the accompanying drawings and the novelty thereof pointed out in the appended claims.

BRIEF DESCRIPTION OF THE ACCOMPANYING DRAWINGS

DETAILED DISCLOSURE AND PREFERRED EXAMPLES OF THE INVENTION

Figure 1:
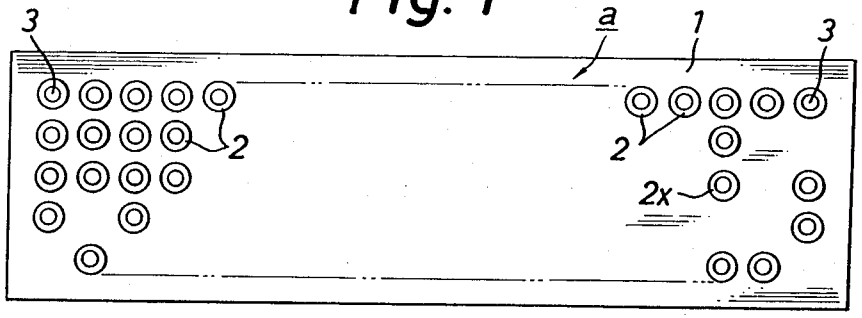
Fig. 1 Prior Art
FIG. 1 is a plan view of a conventional spring unit for a keyboard.
Figure 2:
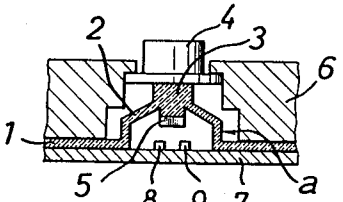
Fig. 2 Prior Art
FIG. 2 is a partially cutaway section view of the spring unit in FIG. 1 which is incorporated in the above conventional keyboard.
Figure 3:
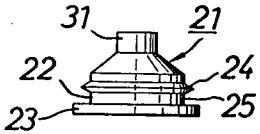
FIG. 3 is a side view of a spring unit for a keyboard according to one example of this invention.
Figure 4:
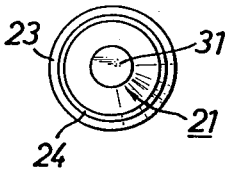
FIG. 4 is a plan view of the spring unit for a keyboard according to the above example.
Figure 5:
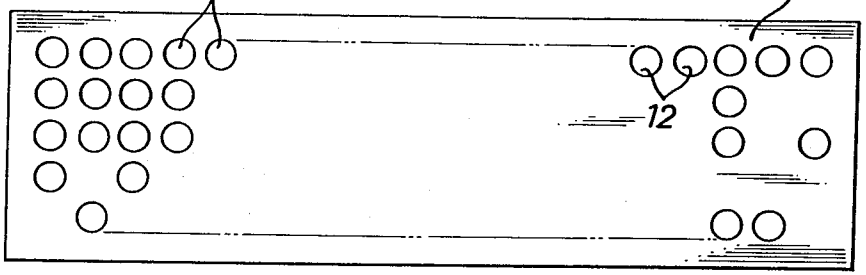
FIG. 5 is an example of a base plate according to this invention.

Preferred examples of this invention will now be described with reference to FIGS. 3 to 7 which use, in part, the same reference numerals as FIGS. 1 and 2 depicting the conventional spring unit.

Numeral 11 is a base sheet and numerals 21 and 211 represent a spring member which can be removably engaged with one opening of a plurality of openings 12 formed in the base sheet 11. Both the base sheet 11 and the spring member 21 or 211 may be made of an identical or different high polymer material. However, the base sheet 11 is preferably made of a hard resin or a metallic material, while the spring member 21 or 211 is preferably made of a high polymer resilient material.

The spring member 21 or 211 is different from the conventional spring 2 that it is at its bottom provided with a flange 23 whose diameter is larger than that of a circular engaging portion 22 as well as of the circular opening 12 of the base sheet 11.

In order to prevent the spring member 21 from being disengaged from the opening 12, the spring member 21 can be provided with a rib 24 adjacent the engaging portion 22; however, rib 24 is optional.

Figure 7:
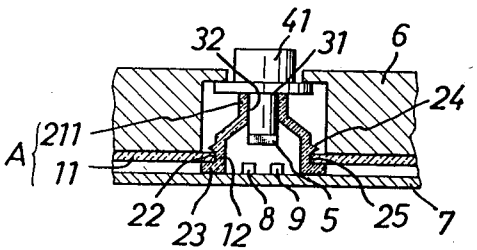
FIG. 7 is a partially cutaway section view of another spring unit of this invention incorporated in the keyboard.
Figure 6:
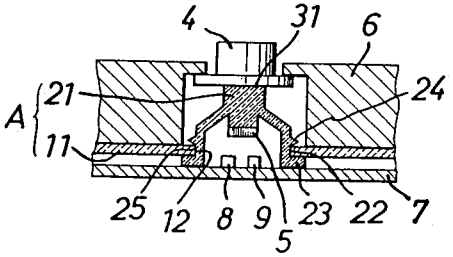
FIG. 6 is a partially cutaway section view showing the spring unit in FIGS. 3 and 5 incorporated in the keyboard.

As shown in FIG. 7, it is possible have a key top assembly 41 with stem 31 engaging and passing through a central cavity 32 of a spring member 211, thereby enabling the movable contact point 5 of the stem 31 to contact the fixed contact points 8 and 9.

Although each opening 12 perforated in the base sheet 11 is shown to be circular, their shape may be modified at one's option. Of course, the circular opening is the best in view of stability.

Thus, a spring unit A for a keyboard may be obtained by engaging and fixing the spring members 21 or 211 with the openings 12 of the base sheet 11. It is desirable to maintain the following conditions in order to make more effective engagement of the spring members 21 or 211 with the openings 12 of the base sheet 11.

Preferably, the diameter of the opening 12 is slightly smaller than that of the engaging portion 22 of the spring member 21 or 211. More preferably, the former diameter of engaging portion 21 is up to about 30% smaller than the diameter of the opening 12.

If the diameter relationship is out of this range, test results indicates that satisfactory engagement of the opening 12 with the engaging portion 22 is not attained.

A circular periphery 25 to be engaged with the opening 12 of the engaging portion 22 is preferably a straight wall whose height is defined suitably by the thickness of the base sheet 1.

By modifying the conditions of the engagement of the base sheet 11 with the spring member 21 or 211, the following slip test has been carried out.

Comparative Test 1

The base sheet 11 was made of a polyester film, but the spring members 21 and 211 were made of a rubber material. The diameter of the opening 12 was formed to be 90% of that of the engaging portion 22. Subsequently, an impact of 2 G was applied to spring member 21 or 211. The following was the test result.

| Thickness (mm) of the base sheet 11: | Diameter (mm) of the engaging portion 22 | | | | | | | | |
|---|---|---|---|---|---|---|---|---|---|
| | Ø18 | | | Ø12 | | | Ø6 | | |
| | Straight height (mm) of the circular periphery 25 of the engaging portion 22 | | | | | | | | |
| | 0.5 | 1.0 | 1.5 | 0.5 | 1.0 | 1.5 | 0.5 | 1.0 | 1.5 |
| 0.1 mm | X | O | O | O | O | O | O | O | O |
| 0.3 mm | X | O | O | X | O | O | O | O | O |
| 0.5 mm | X | X | O | X | O | O | X | O | O |
| 1.0 mm | X | X | O | X | X | O | X | O | O |
| 2.0 mm | X | X | X | X | X | X | X | X | O |

NOTE:
O: Well-engaged,
X: Disengaged

As indicated above, the diameter of the engaging portion 22 is the best at 6ϕ. As it gets larger, the result is worse. Further, a smaller thickness of the base sheet 11 is better, while a higher straight height of the circular periphery 25 is better.

Further, the engagement of the spring member 21 or 211 with the best sheet 11 becomes stronger by mounting on the straight periphery 25 of the spring member 21 or 211 the rib 24 for preventing slip. The following test employs the rib 24.

Comparative Test 2

Like the Comparative Test 1, the base sheet 11 was made of a polyester film, but the spring member 21 and 211 were made of a rubber material. The diameter of the opening 12 was formed to be identical with that of the engaging portion 22. At the same time, the straight height 25 of the engaging portion was formed to be identical with the thickness of the base sheet 11. Subsequently, an impact of 2 G was applied to the spring member 21 or 211. The following was the test result.

| Thickness (mm) of the base sheet 11: | Diameter (mm) of the engaging portion 22 | | | | | |
|---|---|---|---|---|---|---|
| | Ø18 | | Ø12 | | Ø6 | |
| | Height (mm) of the rib 24 | | | | | |
| | 0.1 | 0.2 | 0.1 | 0.2 | 0.1 | 0.2 |
| 0.1 mm | X | O | X | O | O | O |
| 0.3 mm | X | O | O | O | O | O |

-continued

| Thickness (mm) of the base sheet 11: | Diameter (mm) of the engaging portion 22 | | | | | |
|---|---|---|---|---|---|---|
| | Ø18 | | Ø12 | | Ø6 | |
| | Height (mm) of the rib 24 | | | | | |
| | 0.1 | 0.2 | 0.1 | 0.2 | 0.1 | 0.2 |
| 0.5 mm | O | O | O | O | O | O |

NOTE:
O: Well-engaged
X: Disengaged

A smaller diameter of the engaging portion 22 is better, while a higher projection of the rib 24 is better. Further, the thicker base sheet 11 is the better.

Comparative Test 3

The diameter of the opening 12 on the base sheet 11 was formed to be slightly smaller than that of the engaging portion 22, under which circumstances the test for enabling the change of resilience of the spring member 21 or 211 was carried out. The following was the test result.

| Diameter of the engaging portion 22: | Diameter of the opening 12 | | | | | | |
|---|---|---|---|---|---|---|---|
| | Diameter of the engaging portion 22 (Ratio) | | | | | | |
| | 1.0 | 0.95 | 0.9 | 0.85 | 0.8 | 0.75 | 0.7 |
| Ø6 (mm) | 41 g | 40 g | 43 g | 45 g | 51 g | 60 g | 65 g |
| Ø10 (mm) | 56 g | 57 g | 59 g | 62 g | 67 g | 65 g | 78 g |
| Ø18 (mm) | 92 g | 94 g | 98 g | 104 g | 112 g | 119 g | 121 g |

Unit of Weight: gram

Accordingly, as the diameter of the opening 12 of the base sheet 11 becomes smaller than that of the engaging portion 22 of the spring member 21 or 211, the resilience of the spring member 21 or 211 becomes stronger.

Further, it is possible to dispose a coil spring in lieu of the spring member 21 or 211.

This thickness of the base sheet 11 will now be described.

If it is too thick, the use of material becomes wasteful. If it is too thin, the engagement of the spring member 21 or 211 with the base sheet 11 becomes difficult. From this point of view, the thickness of the base sheet 11 is no more than 2 mm, more preferably from 0.1 to 0.5 mm.

Base sheet 11 is associated with a substrate 7 which can be a printed circuit. Alternatively, it is possible to dispose a printed circuit integrally on either the upper surface or the lower surface of base sheet 11, with a plurality of connectors leading from each pair of contact points 8 and 9 in substrate 7. Thus, the structure of the keyboard is simplified and the number of parts is decreased, thereby reducing costs.

The key top 4 or key top assembly 41 of the spring member 21 or 211 is inserted into the opening 12 of the base sheet 11 from below, thereby the circular periphery 25 of the engaging portion 22 contacts an inner circumference of the opening 12 and the flange 23 is engaged with the lower surface of the base sheet 11.

Thus, a spring unit A for a keyboard having a specified number of spring members 21 or 211 can be obtained. And, the spring unit A for a keyboard is mounted in the keyboard body 6 in the conventional way.

According to one aspect of this invention, each of the plurality of spring members can be engaged and fixed with each opening of the base sheet, so that any unsuitable spring member may be replaced easily with a new one. Further, it is possible to dispose a special spring member having a different action property. Accordingly, the formation of the keyboard may be diversified.

According to another aspect of this invention, the base sheet and the spring members respectively can be manufactured with the most suitable material.

According to another aspect of this invention, the base sheet and each of the spring members respectively are manufactured as individual parts, so that it is suited to mass production as well as cost reduction. Particularly, the base sheets can be manufactured effectively by means of such press working as a dieing-out press or the like. Further, the spring members can be manufactured with an output increase of from 1.5 times to twice by a conventional molding machine.

According to a further aspect of this invention, by changing the diameter of the opening of the base sheet as well as that of the engaging portion of the spring member, it is possible to change the resilience properties of the spring unit, i.e. to strengthen it if necessary.

Although this invention has been described in its preferred form with a certain degree of particularity, it is understood that the present disclosure of the preferred form can be changed in the details of construction and in the combination and arrangement of parts.

I claim:

1. A spring unit for a keyboard comprising:

a base sheet made of a hard resinous or metallic material and having a plurality of openings perforated therein in accordance with a specified key layout; and a plurality of individual spring members molded from a high polymer resilient material, each member comprising a dome-shaped head portion, an engaging portion adapted to be removably engaged with an opening perforated in the base sheet, a flange having a larger diameter than the diameter of said opening and adapted to enage the lower surface of said base sheet, and a movable contact point adapted to resiliently close an electrical circuit between two fixed contact points on a substrate.

2. A spring unit according to claim 1 in which the spring member is further provided with a rib adapted to engage the upper surface of the base sheet.

3. A spring unit according to claim 1 in which the diameter of the openings perforated in the base sheet is up to 30% smaller than the diameter of the engaging portion of the spring members.

4. A spring unit according to claim 1 in which the base sheet is provided with a printed circuit which is electrically connected to the fixed contact points.

5. A spring unit for a keyboard comprising:

a base sheet made of a hard resinous or metallic material and having a plurality of openings perforated therein in accordance with a specified key layout; and a plurality of individual spring members molded from a high polymer resilient material, each member comprising a dome-shaped head portion having a cavity, an engaging portion adapted to be removably engaged with an opening perforated in the base sheet, a flange having a larger diameter than the diameter of said opening and adapted to engage the lower surface of said base sheet, and key top assembly having a stem engaging and passing through said cavity, the stem bearing a movable contact point adapted to resiliently close an electrical circuit between two fixed contact points on a substrate.

6. A spring unit according to claim 5 in which the spring member is further provided with a rib adapted to engage the upper surface of the base sheet.

7. A spring unit according to claim 6 in which the diameter of the openings perforated in the base sheet is up to 30% smaller than the diameter of the engaging portion of the spring members.

8. A spring unit according to claim 5 in which the base sheet is provided with a printed circuit which is electrically connected to the fixed contact points.

* * * * *